US005662318A

United States Patent [19]

Harada et al.

[11] Patent Number: 5,662,318

[45] Date of Patent: Sep. 2, 1997

[54] STAPLER AND SHEET-BINDING SYSTEM USING THE SAME

[75] Inventors: Takeshi Harada; Koichi Kitta, both of Yamanashi-ken, Japan

[73] Assignee: Nisca Corporation, Yamanashi-ken, Japan

[21] Appl. No.: 511,689

[22] Filed: Aug. 7, 1995

[30] Foreign Application Priority Data

| | | | |
|---|---|---|---|
| Aug. 8, 1994 | [JP] | Japan | 6-206039 |
| Mar. 17, 1995 | [JP] | Japan | 7-086550 |

[51] Int. Cl.[6] ..... B65H 39/02

[52] U.S. Cl. ..... 270/58.05; 270/58.08; 270/58.11; 227/88; 227/111

[58] Field of Search ..... 270/58.05, 58.08, 270/58.11, 58.12, 58.14, 58.15, 58.16, 58.17, 52.18; 227/111, 134, 156, 87, 88, 89, 90

[56] References Cited

U.S. PATENT DOCUMENTS

| | | | |
|---|---|---|---|
| 3,302,842 | 2/1967 | MacEachron | 227/156 X |
| 4,073,391 | 2/1978 | O'Brien et al. | 270/58.17 X |
| 4,134,672 | 1/1979 | Burlew et al. . | |
| 4,497,478 | 2/1985 | Reschenhofer et al. | 270/58.11 |
| 4,516,714 | 5/1985 | Braun et al. | 227/111 X |
| 4,542,844 | 9/1985 | Olesen et al. . | |
| 4,795,073 | 1/1989 | Yamamoto et al. | 227/156 X |
| 5,005,751 | 4/1991 | Radtke et al. | 270/58.08 X |
| 5,131,641 | 7/1992 | Hidaka | 270/58.08 |
| 5,150,826 | 9/1992 | Logtens | 227/88 |
| 5,263,698 | 11/1993 | Higuchi et al. | 270/58.05 |
| 5,447,298 | 9/1995 | Watanabe et al. | 270/58.11 |
| 5,478,061 | 12/1995 | Murakami et al. | 270/58.08 |

FOREIGN PATENT DOCUMENTS

| | | | |
|---|---|---|---|
| 503896 | 7/1930 | Germany | 227/134 |
| 157515 | 12/1939 | Germany | 227/134 |
| 63-123763 | 5/1988 | Japan . | |
| 1-236167 | 9/1989 | Japan . | |
| 2-32630 | 7/1990 | Japan . | |
| 3-151285 | 6/1991 | Japan . | |
| 4-169291 | 6/1992 | Japan . | |
| 4-169292 | 6/1992 | Japan . | |
| 4-319492 | 11/1992 | Japan . | |
| 4-358891 | 12/1992 | Japan . | |
| 5-16078 | 1/1993 | Japan . | |

*Primary Examiner*—John T. Kwon

*Attorney, Agent, or Firm*—Kane, Dalsimer, Sullivan, Kurucz, Levy, Eisele and Richard, LLP

[57] ABSTRACT

A stapler capable of stapling one or more stapling portions of a sheaf of sheets to be bound with only one movable staple driver in a corner binding manner, one-side binding manner or doublespread binding manner regardless of the width and length of the sheets is applicable to a sheet handling device such as a copying machine and printer to compose a sheet-binding system. The staple driver and clinching means with an anvil for bending the staple into a non-returnable state are connected by a connecting member formed in a substantially U-shape so as to satisfactorily receive the sheets to be stapled.

26 Claims, 11 Drawing Sheets

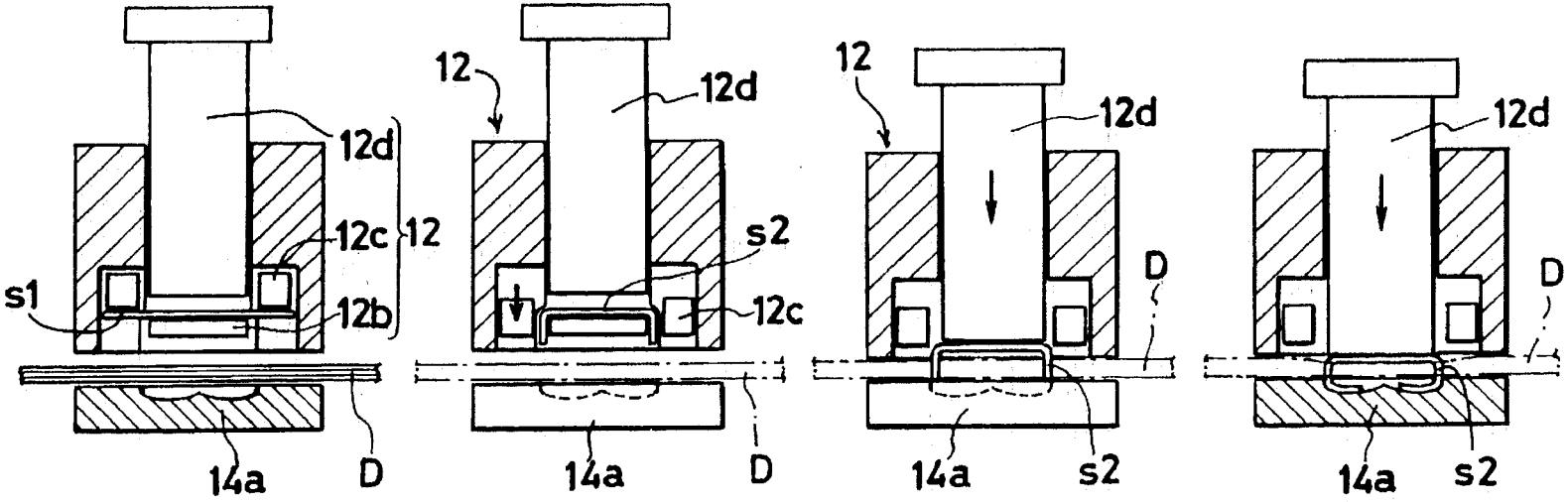
FIG. 3 A
FIG. 3 B
FIG. 3 C
FIG. 3 D
12
12d
12c
12b
s1
s2
14a
D
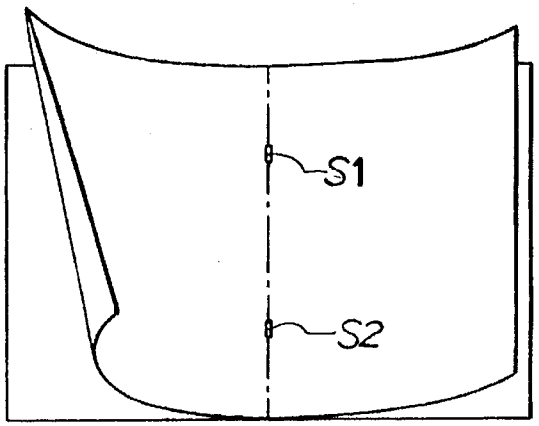
FIG. 5
S1
S2
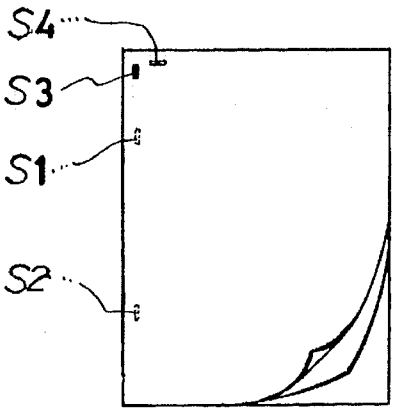
FIG. 6
S4
S3
S1
S2

STAPLER AND SHEET-BINDING SYSTEM USING THE SAME

BACKGROUND OF THE INVENTION

1. Field of the Invention

This invention relates to a stapler for electrically stapling sheets of paper or other material, and more particularly to a stapler provided with a single staple driving unit capable of automatically inserting staples into one or more stapling portions of the sheets to be bound, which is incorporated in a sheet handling device such as a copying machine and printer to form a sheet-binding system.

2. Description of the Prior Art

There have been variety of sheet-binding systems incorporating a stapler capable of automatically stapling a sheaf of sheets of paper discharged from a sheet handling device such as various copying machines or printers. One of prior art staplers applicable for sheet binding has been proposed in U.S. Pat. No. 4,542,844 (corresp. to Japanese Patent Application Public Disclosure No. SHO 59(1984)-64279(A)). This conventional stapler enables staples to be continuously driven while being formed from short lengths of thin wires secured in a belt fashion with a single operation.

For instance, by making such a stapler being driven electrically and incorporated in a copying machine, it is possible to compose an electric sheet-binding device so as to automatically bind copied sheets discharged from the copying machine with one staple, in such a manner as described in U.S. Pat. No. 4,134,672 (corresp. to Japanese Pat. Appln. Pub. Discl. No. SHO 53-119047(A)) and Japanese Pat. Appln. Pub. Discl. No. SHO 61(1986)-9669(A).

The sheets of paper may potentially be bound by forcing two or more staples into stapling positions along one side edge including corners of the sheets at a time by use of a plurality of conventional powered staplers. That is, in order to automatically insert the staples into two or more stapling positions of the sheets to be bound, the staple driving units of the same number as the staples to be inserted into the sheets are required and immovably located at the stapling positions in the sheet-binding device. Thus, it has been impossible to change the stapling positions in accordance with the conditions of binding the sheets, the size of the sheets and so on.

Although the stapler as proposed in Japanese Pat. Appln. Pub. Discl. No. SHO 61(1986)-9669 copes with the size of the sheets to be bound, even this prior art stapler can staple only at a fixed stapling position of the sheets.

There has been a need for a changeable stapling device capable of stapling at one or more arbitrary stapling positions, that is, arbitrarily selecting one of four corners (corner binding), one or more points in one of four sides (one-side binding), and one or more points of the gutter center (center binding or doublespread binding) of the sheets. However, no such convenient stapler has been ever suggested.

A stapler composed of a number of staple driving units immovable fixed may possibly perform stapling at arbitrary binding positions tea certain extent, but installation of the plurality of fixed staple driving units adds to the size and complexity of the stapler, resulting in a large overall size of the system and renders the operation of the binding system difficult. Still more, from any prior art in this field, there has in no way been accomplished a stapler capable of forcing staples into any stapling positions of the sheets of paper by use of a single staple driving unit, e.g. arbitrarily performing the corner binding and one-side binding, much less the doublespread binding with only one staple driving unit.

OBJECT OF THE INVENTION

This invention is made in view of the inconvenienced situation of the conventional powered stapler applicable to a sheet handling device as described above and has an object to provide a simple and convenient stapler capable of arbitrarily binding any stapling portions of sheets of paper or other material with only one staple driving unit so as to perform corner binding and/or one-side binding or doublespread binding without any restraint.

Another object of this invention is to provide a stapler incorporated in an automatic sheet-binding system capable of binding one or more prescribed stapling positions of the corners, one side edge or gutter center of a sheaf of sheets with one or more staples by use of only one staple driving unit regardless of the width and length of the sheets.

Still another object of this invention is to provide a sheet-binding system applicable to a sheet handling device such as a copying machine and printer, which is provided with a stapler having a single staple driving unit and can automatically bind sheets discharged from the sheet handling device in a corner binding, one-side binding or doublespread binding manner.

SUMMARY OF THE INVENTION

To attain the objects described above according to this invention, there is provided a stapler comprising a single staple driving unit including a staple driver for forcing one or more staples one by one into sheets, clinching means for bending the pointed ends of the staple piercing through the sheets into a non-returnable manner, and a connecting member for connecting the staple driver with the clinching means; and means for moving the staple driving unit in the direction of the width of the sheets.

The connecting member is formed in a substantially U-shape and extends in the direction of the length or width of the sheets in a detour manner so that the staple driving unit is movable in the width direction of the sheets so as to admit the sheets into between the staple driver and the clinching means.

Thus, the staples can be arbitrarily inserted into a plurality of stapling portions of the sheets by moving the staple driving unit in the width direction of the sheets placed between the staple driver and the clinching means. Therefore, one or more portions of the sheets can be bound regardless of the width and length of the sheets.

Incorporation of the aforementioned stapler in a sheet handling device such as a copying machine and printer fulfills an automatic sheet-binding system capable of automatically binding the corner, one-side edge or gutter center of the sheets discharged from the sheet handling device.

Other and further objects of this invention will become obvious upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

FIG. 3A through FIG. 3D are schematic front views showing a process in which a staple is formed and forced into sheets by the staple of this invention.

FIG. 5 is an explanatory diagram showing one example of performing doublespread binding by using the stapler according to this invention.

FIG. 6 is an explanatory diagram showing another example of performing corner binding and one-side binding by using the stapler according to this invention.

DESCRIPTION OF THE PREFERRED EMBODIMENTS

The electric stapler of this invention has a unique function of binding one or more prescribed stapling portions of a sheaf of sheets with only one staple driving unit, and applied to a sheet handling device such as a copying machine and printer, thus forming a sheet-binding system capable of automatically binding the sheets discharged from the sheet handling device.

Figure 1:
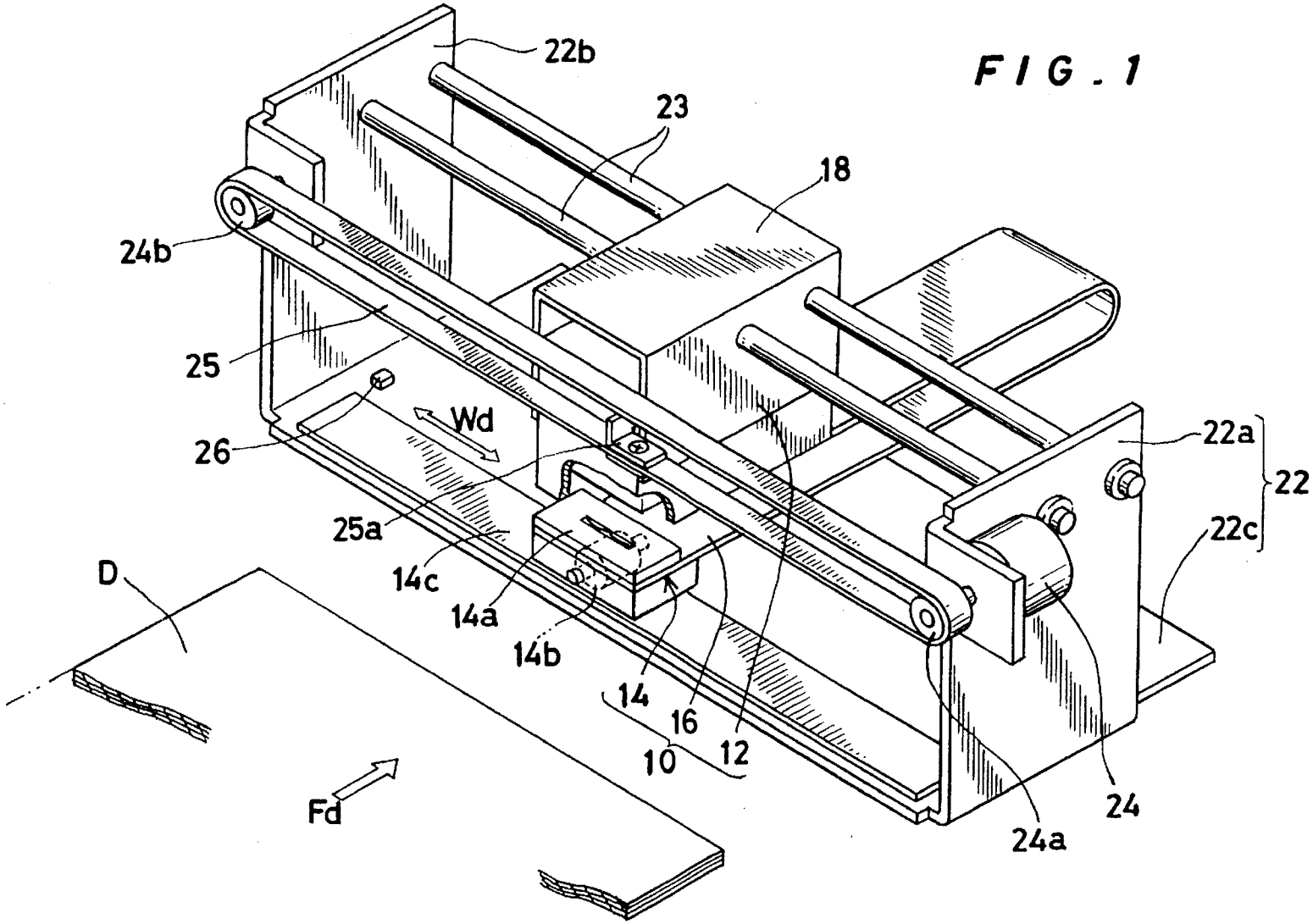
FIG. 1 is a partial cutaway perspective view showing one embodiment of a stapler according to this invention.
Figure 2:
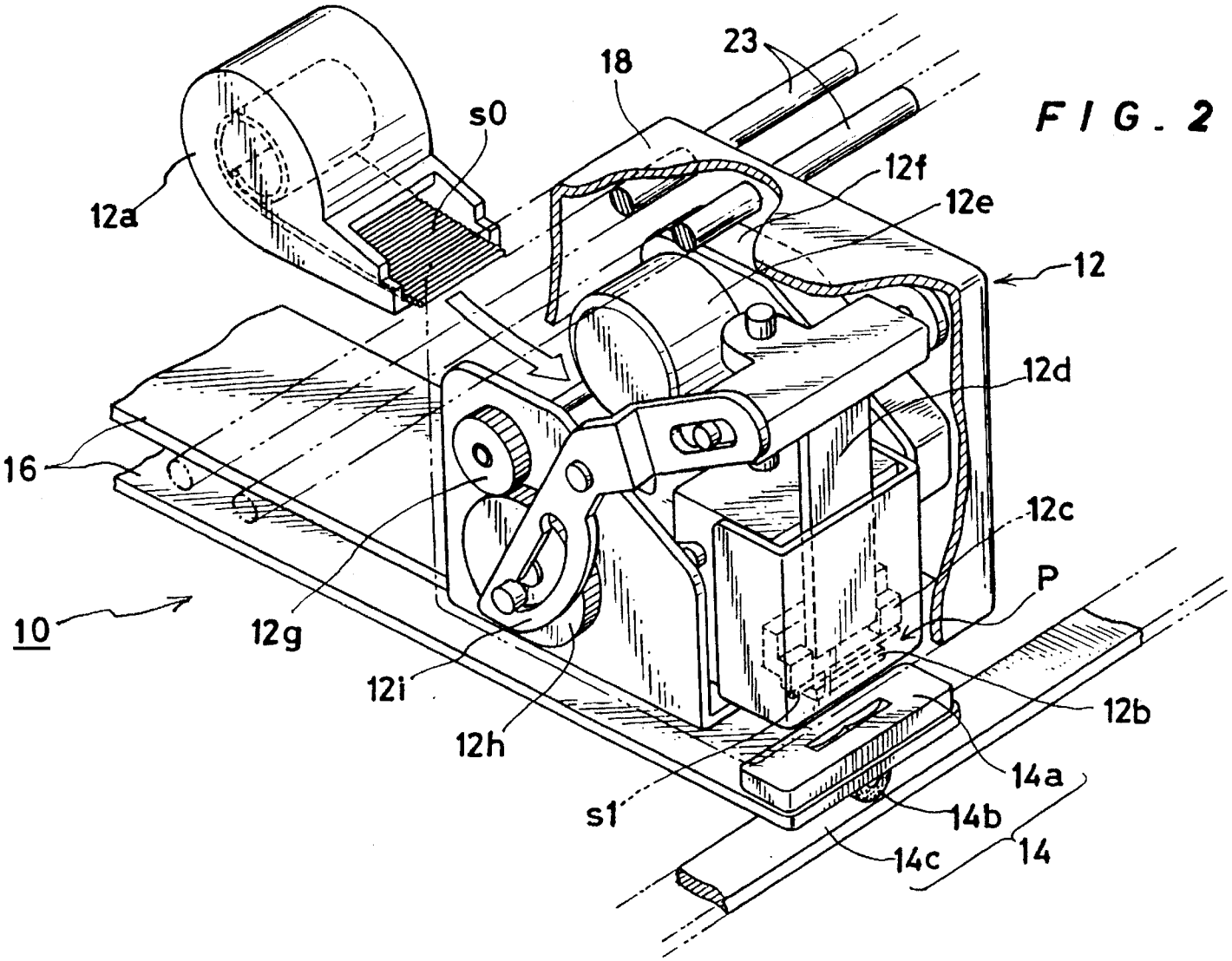
FIG. 2 is a partial cutaway perspective view showing a staple driving unit of the stapler in FIG. 1.

As illustrated in FIG. 1, the stapler according to the invention comprises the aforesaid staple driving unit 10, and means 20 for moving the unit 10.

The staple driving unit 10 includes a staple driver 12 for inserting a staple into a given sheaf of sheets D of paper or other material, clinching means 14 having an anvil 14*a* for catching and bending the pointed ends of the staple piercing through the sheets D in a non-returnable manner, and a connecting member 16 for connecting the staple driver 12 with the clinching means 14.

The sheets D is admitted into between the staple driver 12 and the anvil 14*a* of the clinching means 14. To be more specific, the connecting member 16 is formed in a substantially U-shape or like a tuning fork and extends in the direction of the length of the sheets (forwarding direction Fd) in a detour manner so that the staple driving unit is movable in the width direction Wd of the sheets, which is perpendicular to the aforementioned forwarding direction Fd, in such a state that the sheets are placed between the staple driver 12 and the anvil 14*a*.

As shown in FIG. 2 and FIG. 3A through FIG. 3D as one example, the staple driver 12 includes a staple-element cartridge 12*a* which contains a belt (s0) composed of short thin straight element wires, a retractable retainer 12*b* for temporarily retaining one element wire s1 at a forming portion $P_{ST}$, a fork-shaped push member 12*c* for pushing down both pointed end portions of the element wire s1 held by the retainer 12*b* so as to bend the element wire into a square U-shape, thereby to form a staple s2, and a driving blade 12*d* for forcing the staple s2 into sheets D placed between the staple driver 12 and the clinching means 14.

The push member 12*c* and driving blade 12*d* are actuated by a driving system which consists of a drive motor 12*e*, transmission means including a reduction unit 12*f* and a gear 12*g*, and a cam mechanism consisting of a cam wheel 12*h*, and a cam lever 12*i*. By actuating the cam mechanism, the push member 12*c* and driving blade 12*d* are operated differentially.

That is to say, the sheets D to be bound are first put into between the staple driver 12 and the clinching means 14 as shown in FIG. 3A. At this time, the straight element wire s1 is held by the retainer 12*b*, and the push member 12*b* and the driving blade 12*d* are kept at their uppermost positions. Next, the motor 12*e* is driven to actuate the cam wheel 12*h* and cam lever 12*i* to thrust down the push member 12*c*, both pointed end portions of the element wire s1 held by the retainer 12*b* are bent downward into a square U-shape to form a staple s2 as shown in FIG. 3B. Thereafter, the retainer 12*b* is retracted to release the staple s2 so that the staple s2 is held frictionally by the fork-shaped push member 12*c*, and then, the driving blade 12*d* is thrust down to force the staple s2 down into the sheets D as shown in FIG. 3C. By further pressing the staple s2 down, as shown in FIG. 3D, the pointed ends of the staple s2 are bent along the groove bottom surfaces of the anvil 14*a* into a substantially ω-shape or any other non-returnable shape such as an arc. Thus, the document D is bound with the staple s2.

The staple driver 12 is contained in a casing 18.

The aforesaid structure of the staple driver 12 is by and large found in a conventional powered stapler, but this invention does not contemplate imposing any limitation on the structure of the staple driver. The stapler of this invention may have any other desired staple driver.

In this embodiment, the connecting member 16 is formed in such a manner that a long strip of flat plate or bar having a rectangular section is bent into a substantially U-shape, but may be formed of a channel section band plate bent in a substantially U-shape to heighten the strength.

The connecting member 16 extends sufficiently in the lengthwise direction of the sheets (forwarding direction Fd) so as to admit the sheets into between the staple driver 12 and the clinching means 14. Practically, the connecting member 16 may extend so as to receive at least half the length of the sheets.

The moving means 20 includes guide rods 23 disposed in parallel between opposite side walls 22*a* and 22*b* of a frame 22, a reversible motor 24 attached to the side wall 22*a*, and transmitting means 25 interposed between the staple driver 12 and the motor 24 for transferring the rotation of the motor 24 to the staple driver 12 so as to move the staple driver 12 back and forth in the width direction Wd of the sheets D along the guide rods 23.

In this embodiment, a pair of parallel guide rods 23 each made of a round bar, but may be replaced with one square bar or three or more rods.

The motor 24 is preferably a pulse motor or stepping motor capable of controlling its rotation quantitatively, so that the staple driving unit 10 can be moved to the desired stapling position with accuracy.

The transmitting means 25 is formed of an endless belt with racks, which is suspended between a toothed wheel 24*a* attached to a rotating shaft of the motor 24 and a toothed wheel 24*b* supported on the side wall 22*b*. However, this structure is by no means limitative and the transmitting means 25 for moving the staple driver 12 widthward may be formed of any other compositions such as a combination of a worm rod and a worm gear.

Figure 4:
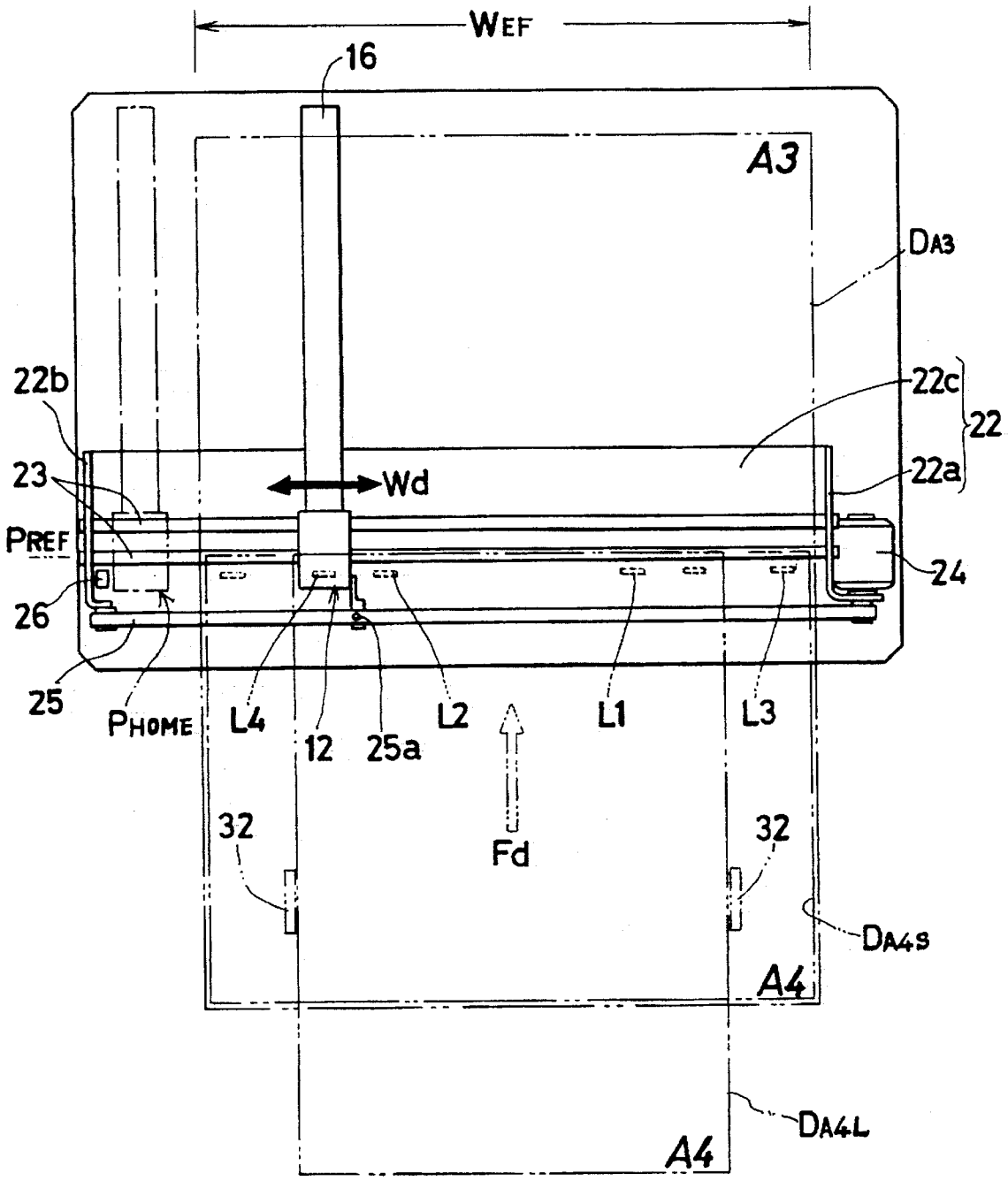
FIG. 4 is a schematic plan view showing stapling positions in the staple of this invention.

At a home position ($P_{HOME}$ in FIG. 4) to which the staple driver 12 moves to step aside, a home position sensor 26 for detecting the staple driver 12 arriving at the home position $P_{HOME}$. That is to say, as illustrated in FIG. 4, the interval between the toothed wheels 24*a* and 24*b* (corresponding to that between the side walls 22*a* and 22*b* or the length of the guide rod 23) is made somewhat larger than the sum of the width of the staple driver 12 and the effective area $W_{EF}$ in which the sheets of maximum size, e.g. A3-size sheet as shown in FIG. 4 is handled, so that the staple driver 12 can retreat from the stapling zone (effective area $W_{EF}$) into the home position when the sheets D bound with a staple or staples are discharged in the forwarding direction Fd in which the sheets D is fed.

The clinching means 14 has a slide member 14*b* attached to the lower surface of the anvil 14*a* through the connecting member 16 to permit smooth movement of the staple driver 12 in the width direction. The slide member 14*b* in this embodiment is composed of a roller. On the bottom plate 22*c* of the frame 22, a support member 14*c* is laid for supporting and guiding the slide member 14*b*.

Thus, by driving the motor 24, the staple driving unit 10 consisting of the staple driver 12, clinching means 14 and connecting member 16 is moved along the guide rods 23 in the width direction Wd. Accordingly, upon placing the staple driving unit 10 at a stapling position determined on the sheets D between the staple driver 12 and the anvil 14*a*, the staple driver 12 is actuated to force a staple into the sheets D. To staple another stapling position on the sheets D, the staple driving unit 10 may be moved there and actuated in the same manner.

Upon completion of stapling one or more stapling positions of the sheets D, the sheets thus bound are removed out of the stapling portion defined between the staple driver 12 and the clinching means 14. When discharging the bound sheets in the forwarding direction Fd, the staple driving unit 10 is retracted to the home position $P_{HOME}$ shown in FIG. 4.

In the case of returning the bound sheets in the direction opposite to the direction Fd after stapling, the staple driving unit 10 need not move.

As is understood from FIG. 4, within the effective width area $W_{EF}$ defined by subtracting the home position $P_{HOME}$ (nearly equal to the width of the staple driver 12) from the interval between the side walls 22*a* and 22*b*, the sheet of the maximum size, such as of A3-size sheet $D_{A3}$ of 297 mm width and 420 mm length, are dealt with as shown in FIG. 4. The length of the sheets to be stapled is limited by the substantially U-shaped connecting member 16 extending in the forwarding direction.

The length of the connecting member 16 is made shorter than that of the maximum sheet, e.g. the A3-size sheet, to be fed in its longitudinal direction in the illustrated embodiment, but may of course be longer than the same. The reason why the connecting member 16 is shorter than the maximum sheet (A3-size sheet) is that stapling is performed at the points L1 and L2 in the center (gutter center) of the sheets $D_{A3}$, thus to produce a double-spread booklet bound with staples S1 and S2 as illustrated in FIG. 5.

In the case that one longitudinal side of a sheaf of A4-size sheets $D_{A4S}$ is bound to make a one-side bound booklet stapled with staples S1 and S2 as indicated by dotted lines in FIG. 6, the sheets are fed sideways in the forwarding direction Fd as shown in FIG. 4 until the side edge of the sheets is located at the stapling reference position $P_{REF}$. In the same way, only the corner of the sheets $D_{A4S}$ may be bound at a stapling position L3, thus making a corner-bound booklet stapled with a staple S3 as shown in FIG. 6.

By stapling the point L4 of one top corner of A4-size sheets fed in the longitudinal posture as indicated by an imaginary line $D_{A4L}$ in FIG. 4, a booklet bound with a staple S4 as illustrated in FIG. 6 may be obtained.

Thus, according to the present invention, sheets of different sizes can be freely bound with ease to automatically produce variously stapled booklets.

Figure 7:
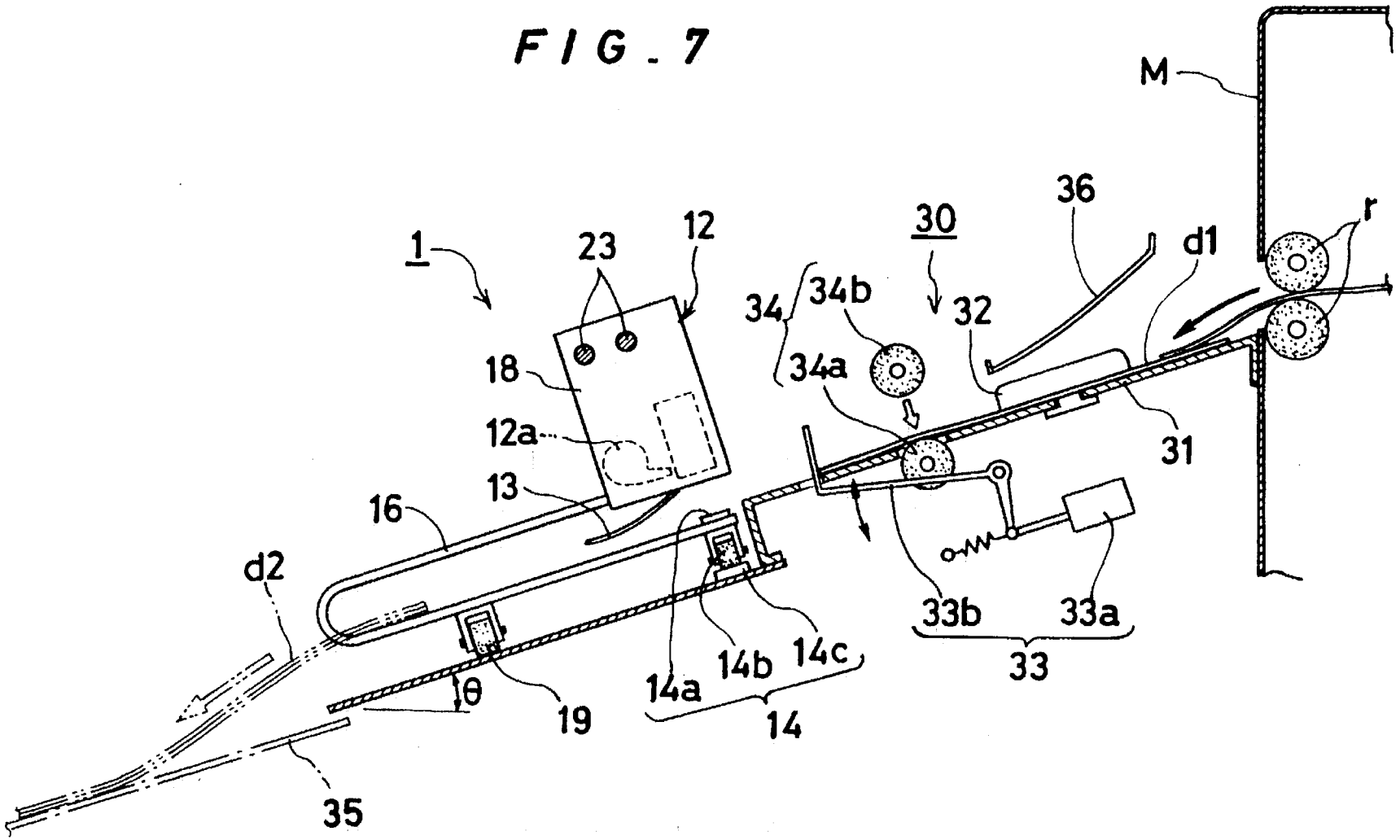
FIG. 7 is a side view schematically showing a second embodiment of the stapler of this invention, applied as a sheet-binding system.

As illustrated in FIG. 7 as another embodiment of the invention, the stapler 1 of this invention is suitable as a sheet-binding system for a sheet handling device M such as a copying machine.

The stapler 1 which comprises, as specified above, the staple driving unit 10 including the staple driver 12, clinching means 14 and connecting member 16, is united to the sheet handling device together with a collating unit 30 to which sheets d1 are sent out one by one from the sheet handling device M through discharge rollers r.

The collating unit 30 comprises a stacker tray 31, a pair of side regulating plates 32 (FIG. 4) movable widthward for truing up the side edges of the sheets d1 fed onto the stacker tray 31, a stopper 33 retractable vertically at the front end portion of the stacker tray 31 so as to selectively bar the way of the sheets, and means 34 for feeding the sheets into between the staple driver 12 and the clinching means 14 of the stapler 1.

As shown in FIG. 7 by way of example, the stopper 33 comprises a solenoid 33*a* with a reciprocating rod, and a substantially Z-shaped stopper lever 33*b* pivoted at one nodal point thereof. The stopper lever 33*b* is connected at its one end to the reciprocating rod of the solenoid 33*a*. By actuating the solenoid 33*a* of the stopper 33, the other end of the stopper lever 33*b* is protruded upward or retracted downward through the tray 31.

The feeding means 34 in this embodiment is composed of a stationary roller 34*a* partially exposed upward from the stacker tray 31 and a movable roller 34*b*. The movable roller 34*b* is apart from the stationary roller 34*a* in a normal state, particularly when the sheets d1 are sent out from the sheet handling device M onto the tray 31. However, the movable roller 34*b* comes into frictional contact with the stationary roller 34*a* while rotating, when the sheets d1 on the tray 31 are fed into between the staple driver 12 and the anvil 14*a* and discharged therefrom.

When the sheets d1 are discharged onto the tray from the sheet handling machine M, the stopper 33 is protruded upward to interrupt the advance of the sheets and true up the front edges of the sheets d1. When feeding the sheets d1, the stopper 33 is retracted downward to permit the sheets to be transferred by the feeding means 34.

Therefore, the sheets d1 fed from the stacker tray 31 into between the staple driver 12 and the clinching means 14 are bound with a staple or staples at the prescribed stapling position or positions by the staple driver 12 in the manner as described above. Thereafter, the bound sheets d2 are sent out onto a discharge tray 35 by the feeding means 34 as the staple driver 12 moves to the home position $P_{HOME}$. Since the stapler 1 is inclined at the angle θ relative to the sheet handling machine M, the bound sheets d2 freely fall onto the discharge tray 35 when being released from the feeding means 34.

In FIG. 7, reference numeral 36 denotes a guide plate defining a sheet passage in conjunction with the tray 31, and numeral 13 denotes a flexible guide member for facilitating the insertion of the sheets d1 into between the staple driver 12 and the anvil 14*a*.

In this embodiment, an auxiliary slide member 19 formed of a roller is attached to the substantially middle portion of the connecting member 16 for increasing the stability in moving the staple driving unit 10.

The stapler 1 incorporated in the sheet handling machine establishes a sheet-binding system capable of automatically binding the sheets discharged from the sheet handling machine with one or more staples in a rational manner.

Figure 8:
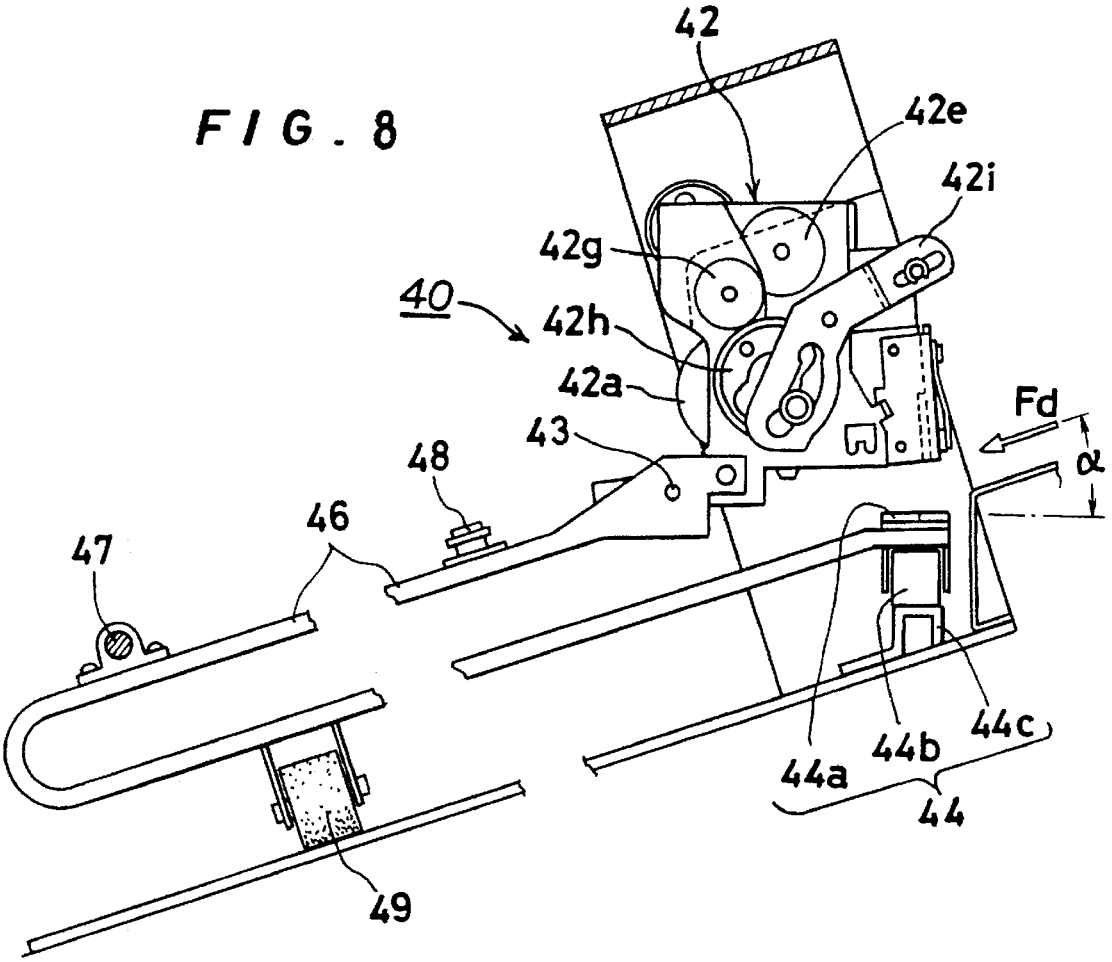
FIG. 8 is a schematic side view showing a third embodiment of the stapler of this invention.

The third embodiment of the invention shown in FIG. 8 comprises a staple driving unit 40 having a staple driver 42 movable rockingly about a pivot pin 43 at the angle α relative to a connecting member 46, and clinching means 44 having an anvil 44*a*. That is to say, the staple driving unit 40 rotates on the pivot pin 43 toward clinching means 44 when stapling.

The staple driver 42 of this embodiment is essentially identical with the staple driver 12 of the foregoing embodiments. Namely, the staple driver 42 includes a staple-element cartridge 42*a*, a motor 42*e*, a reduction unit 42*f*, a gear 42*g*, a cam wheel 12*h* and a cam lever 42*i*, and further comprises, though not shown, a retainer, a push member and a driving blade similarly to the foregoing embodiments.

The staple driving unit 40 in this embodiment may be replaced with the unit 10 shown in FIG. 7. However, in this embodiment, since the staple driver 42 rotates about the pivot pin 43 at the angle α when stapling, the anvil 44*a* is also inclined at the angle α relative to the forwarding direction Fd in which sheets are fed into between the staple driver 42 and the clinching means 44. A slide member 44*b* and a support member 44*c* as well as the anvil 44*a* are inclined at the angle α relative to the forwarding direction Fd.

Furthermore, in this embodiment, a guide rod 47 for assuring stable parallel movement of the staple driving unit 40, an endless belt 48 being one of components of moving means, and an auxiliary slide member 49 composed of a roller are attached to the connecting member 46.

Figure 9:
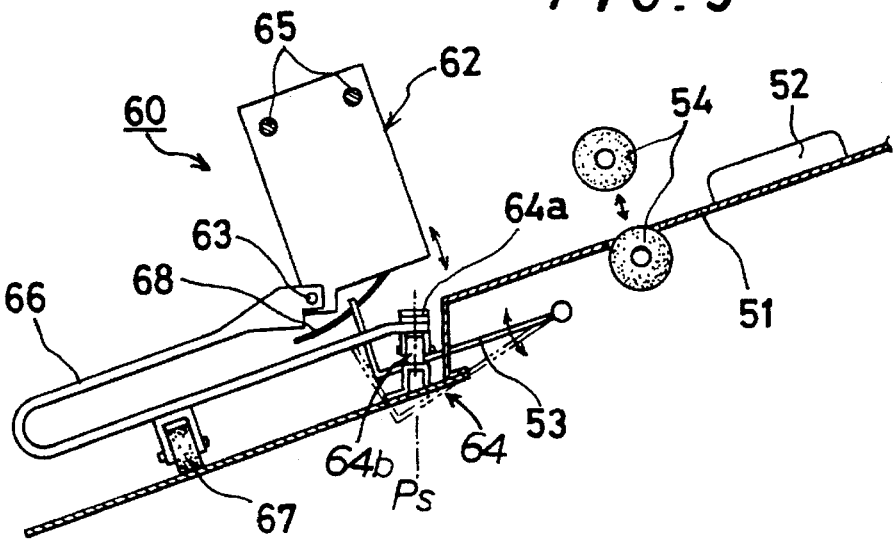
FIG. 9 is a schematic side view showing a fourth embodiment of this invention.

The stapler of this embodiment can be united to the sheet handling device M and the collating unit 30 without revision, and modified to a collating unit 50 shown in FIG. 9 as the fourth embodiment of the invention.

Similarly to the staple driver 42 in FIG. 8, a staple driver 62 in a staple driving unit 60 shown in FIG. 9 is rotatable about a pivot pin 63 so as to come in touch with an anvil 64*a* of the clinching means 64 when stapling. As well, guide rods 65 slidably pierce the staple driving unit 60 similarly to the first embodiment of FIG. 1. The connecting member 66 is further provided with an auxiliary slide member 67 so as to permit the staple driving unit 60 to smoothly move in parallel along the guide rods 65 in conjunction with the slide member 64*b* of the clinching means 64.

Between the staple driving unit 62 and the clinching means 64, a flexible guide member 68 is disposed for allowing easy admission of the sheets into between the unit 62 and the clinching means 64, similarly to the second embodiment of FIG. 7.

The collating unit 50 comprises a stacker tray 51, side regulating plates 52 movable widthward for truing up the side edges of the sheets fed onto the stacker tray 51, a stopper 53 movable vertically so as to selectively bar the way of the sheets, and means 54 for feeding the sheets into between the staple driver 62 and the clinching means 64, similarly to the embodiment of FIG. 7.

In this embodiment, the free end of the stopper 53, which is protruded upward and retracted downward, is located beyond a stapling position Ps so that the sheets discharged from a sheet handling device (not shown) can be trued up by the stopper 53 and stapled by the staple driver 62 at the same place. Besides, this embodiment can make the sheet-binding system including the collating unit and the stapler compact.

Figure 10:
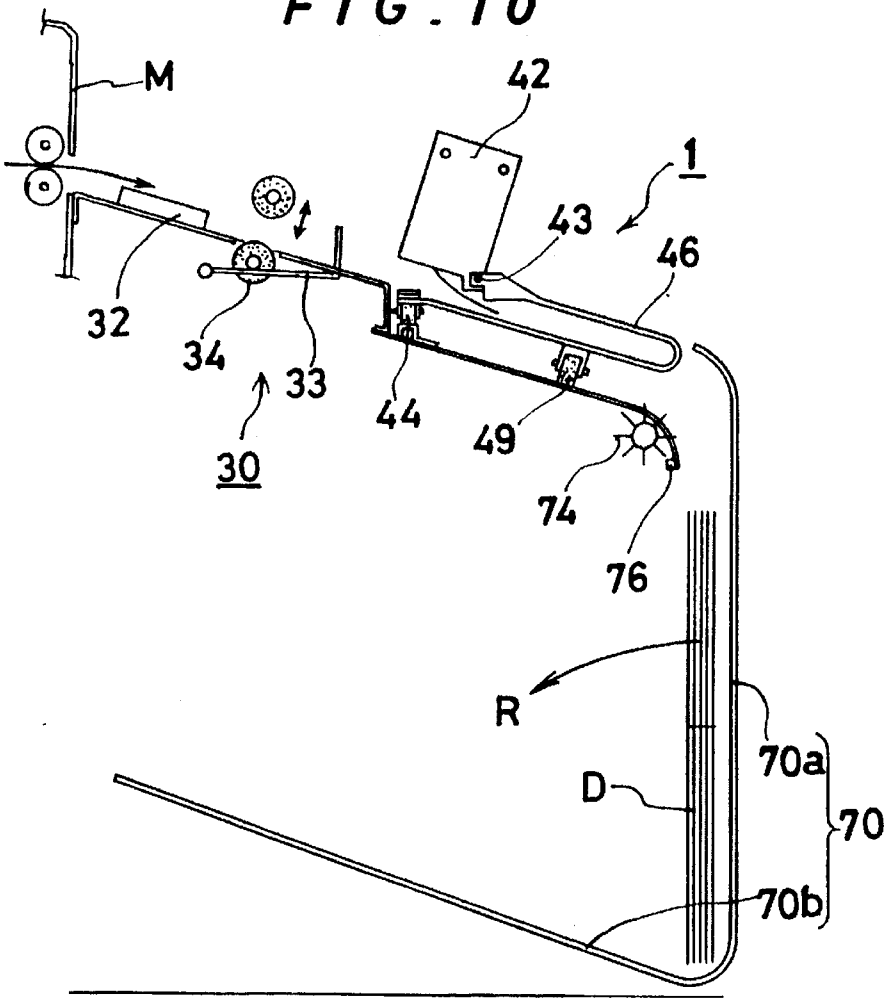
FIG. 10 is a schematic side view showing a fifth embodiment of the stapler of this invention, incorporated in another sheet-binding system.

FIG. 10 shows the fifth embodiment in which a sheet-binding system comprises of the staple driving unit 40 of FIG. 8 and the collating unit 30 illustrated in FIG. 7. In the illustrated embodiment, the reference numerals which have substantial equivalents in the diagrams of the embodiments mentioned above denote identical or equal component parts. The description of these component parts is omitted below to avoid repetition.

The sheet-binding system of FIG. 10 is attached to the sheet discharge section of a sheet handling device M. Sheets are discharged from the sheet handling device to the collating unit 30 and trued up by means of the side regulating plates 32 and the stopper 33. Then, the sheets are fed into between the staple driver 42 and the clinching means 44 in the stapler 1 to be bound with one or more staples.

The sheets which are bound in a doublespread binding manner by the stapler 1 by way of example is introduced into a sheet receptacle 70 while being guided by a fin feed wheel 74. In the receptacle 70, the sheets D first fall vertically along the side wall 70*a* of the receptacle 70 as illustrated, and then, come down onto the slant bottom 70*b* as indicated by the arrow R.

With this structure of the sheet receptacle 70, the doublespread booklet resultantly obtained is placed on the bottom 70*b* in the same posture as the sheets discharged from the sheet handling device onto the collating unit 30.

The sheet receptacle 70 in this embodiment is provided at its entrance with a sheet sensor 76 for detecting the sheets D passing through a passage from the stapler 1 into the receptacle 70. If the sensor 76 does not detect the sheets D at a prescribed time after stapling in the stapler 1, it is possible to derive a conclusion that jamming of sheets or other defective operation is caused, consequently to halt the operation of the sheet handling device, thus preventing trouble of the device beforehand.

Figure 11:
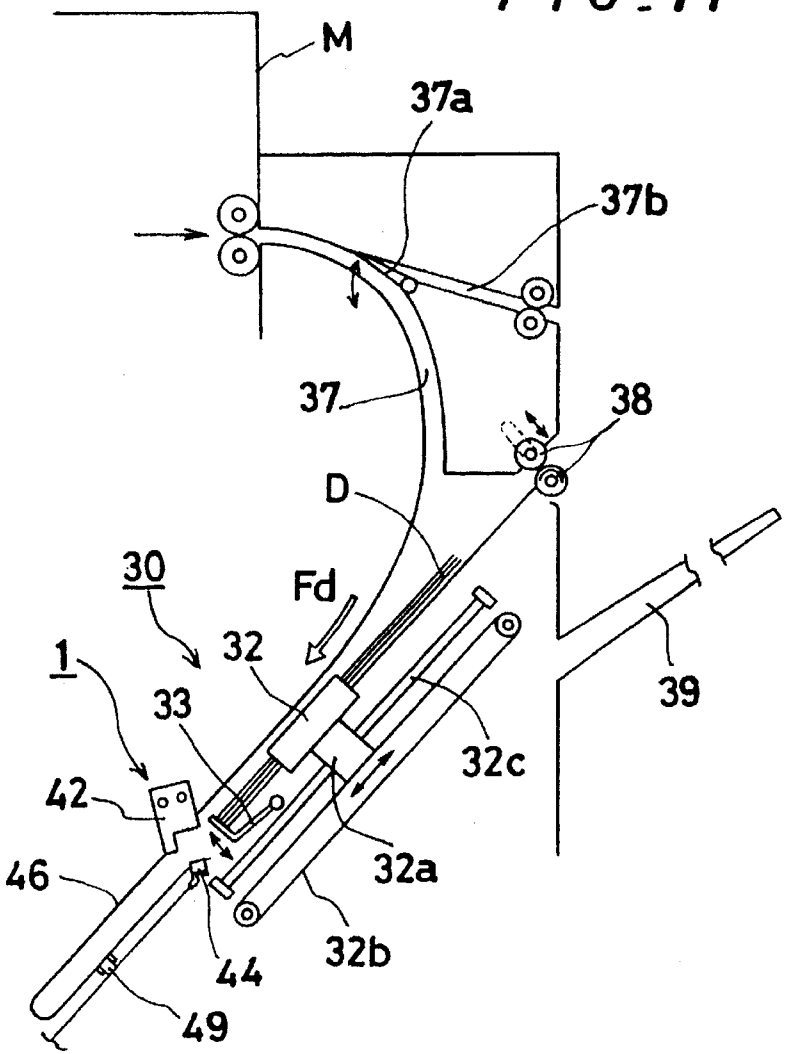
FIG. 11 is a schematic side view showing a sixth embodiment of a sheet-binding system incorporating the stapler of this invention.

The embodiment shown in FIG. 11 also employs the stapler of FIG. 8. The collating unit 30 in this embodiment has a function of sending back the sheets stapled by the stapler 1 in the opposite direction to the forwarding direction Fd. That is, the side regulating plates 32 of the collating unit 30 is carried on a carriage 32*a* which is moved back and forth by driving means 32*b* along a guide rod 32*c*.

The sheets discharged from the sheet handling device M is fed to the collating unit 30 through a sheet path 37 and steadily held by the side regulating plates 32. When the prescribed number of sheets are gathered in the collating unit 30, the stopper 33 is released to permit admission of the sheets D into between the staple driver 42 and the clinching means 44 in the stapler 1. The sheets D as held by the side regulating plates 32 are stapled by the stapler 1, and thereafter, sent back by reversing the driving means 32*b*. When the sheets D bound with one or more staples reach discharge rollers 38, they are released from the side regulating plates 32 and fed out onto a discharge tray 39.

When there is no call for stapling the sheets discharged from the sheet handling device M, a switch lever 37*a* is changed over so as to discharge the sheet directly to the discharge tray 39 through a direct discharging path 37*b* without passing through the sheet-binding system consisting of the stapler 1 and the collating unit 30.

Thus, the sheet-binding system incorporating the stapler according to this invention is applicable to all sorts of sheet handling devices.

Figure 12:
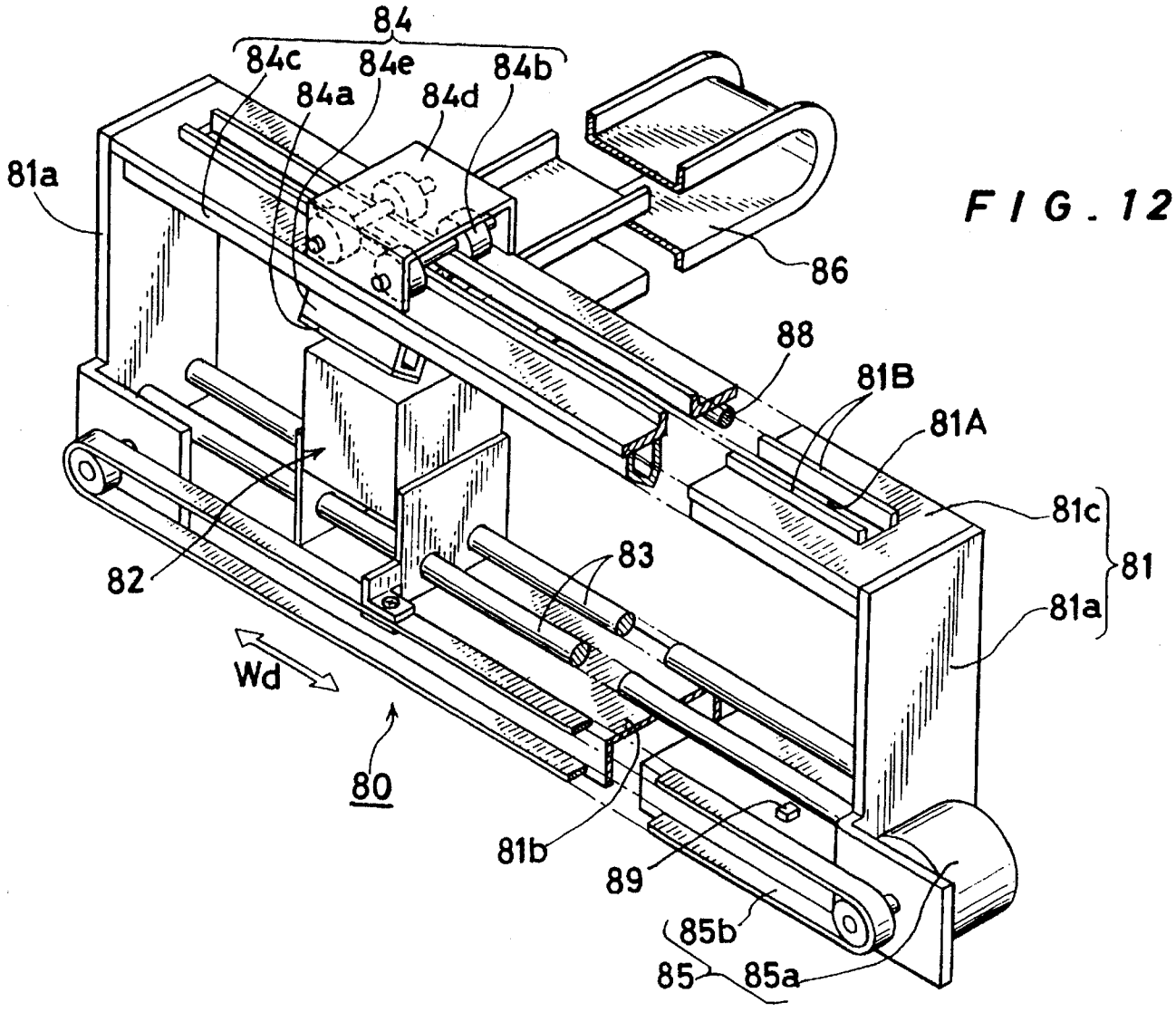
FIG. 12 is a partial cutaway perspective view showing a seventh embodiment of the stapler of this invention.

The foregoing embodiments have a structure suitable for particularly forcing a staple downward into sheets having copied or printed surfaces upward. However, there has been felt a necessity for a stapler in which a staple driver is arranged beneath an anvil so as to insert a staple upward into the sheets according to the purposes for which they are used. In such a case, the aforenoted staplers may be merely inverted, or otherwise, the embodiment shown in FIGS. 12 and 13 may be adopted.

In this embodiment, the elements depicted by like reference numerals with respect to those of the foregoing embodiments have substantially analogous structures and functions to those of the foregoing embodiments and will not be described in detail again.

In a staple driving unit 80, clinching means 84 including an anvil 84*a*, a slide member 84*b* composed of rollers, and a support member 84*c* is arranged above a staple driver 82. The clinching means 84 and the staple driver 82 are connected by a connecting member 86. The unit 80 is slidably supported by guide rods 83 extending between side walls 81*a* along a bottom plate 81*b* of a frame 81 and moved widthward by moving means 85 including a reversible motor 85*a* and an endless belt 85*b*.

Figure 13:
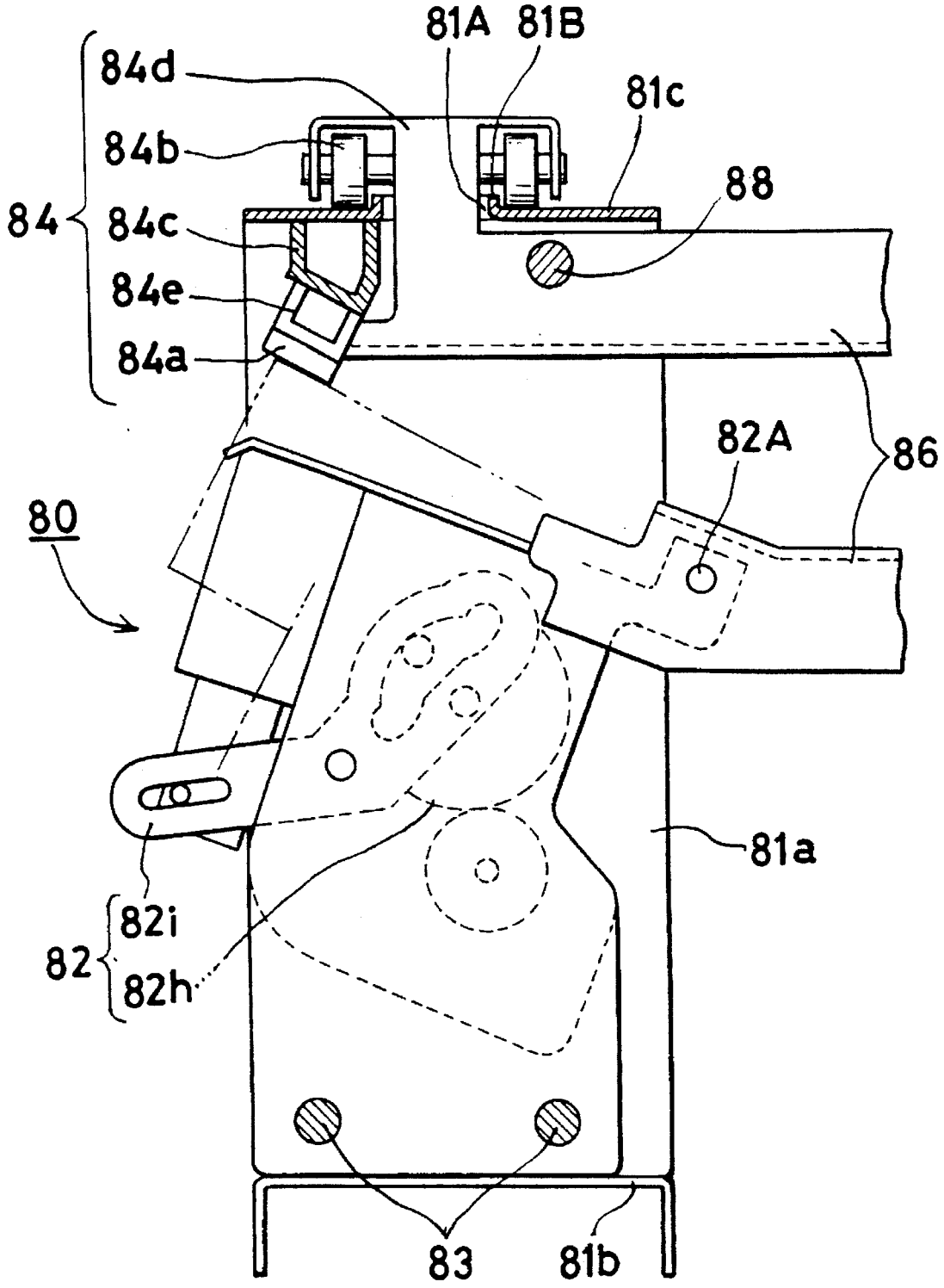
FIG. 13 is a schematic side view partially showing the principal portion of the stapler of FIG. 12.

As is clear from FIG. 13, the clinching means 84 is suspended from an upper plate 81*c*. Namely, the slide member 84*b* is retained by a hanger 84*d* formed between the clinching means 84 and the connecting member 86, which is pierced through a guide slot 81A formed in the upper plate 81*c*. To move the unit 80 stably, the rollers of the slide member 84*b* are guided by upright walls 81B formed along the edges of the guide slot 81A.

In this embodiment, in a normal state, the support member 84*c* may be out of contact with an anvil supporter 84*e* to which the anvil 84*a* is fixed. An auxiliary guide rod 88 is disposed in parallel to the guide rods 83 for assuring stability of the widthward movement of the unit 80, but it is not always necessary to this embodiment.

The staple driver 82 movable rockingly about a pivot pin 82A is provided with a cam wheel 82*h* and cam lever 82*i* similarly to the first embodiment touched upon above.

This embodiment adopts the connecting member 86 formed by bending a channel section plate into a substantially U-shape.

In the illustrated embodiment, reference numeral 89 denotes a home position sensor 89 equivalent to the sensor 26 in FIG. 1.

According to this embodiment, a sheaf of sheets can be effectively stapled upwardly from the underside thereof.

Figure 14:
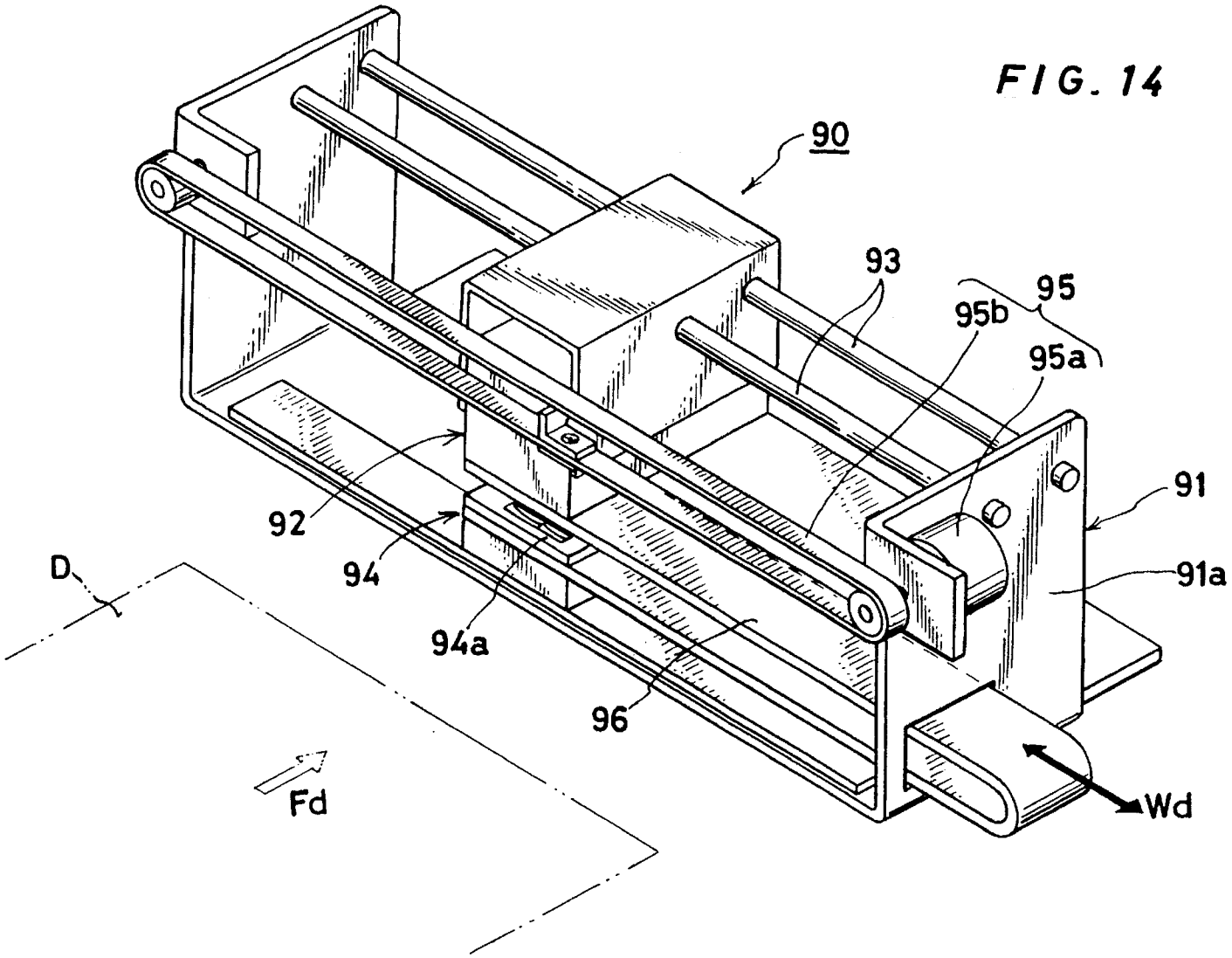
FIG. 14 is a schematic perspective view showing an eighth embodiment of the stapler of this invention.

The eighth embodiment shown in FIG. 14 has a connecting member 96 extending in the width direction Wd perpendicular to the direction Fd in which sheets D are introduced into between a staple driver 92 of a staple driving unit 90 and an anvil 94*a* of clinching means 94. Most elements of this stapler other than the connecting member 96 have the substantially same structure and function as their counterparts in the first embodiment depicted in FIG. 1.

To be specific, The staple driving unit 90 comprises the staple driver 92, the clinching means 94 with the anvil 94*a*, and the connecting member 96 for connecting the staple driver 92 with the clinching means 94. The staple driver 92 is supported by guide rods 93 arranged in parallel between side walls 91*a* of a frame 91, and slidably driven widthward along the guide rods 93 by moving means 95 consisting of a reversible motor 95*a* and an endless belt 95*b*.

One or more stapling portions of the sheets D placed between the staple driver 92 and the anvil 94*a* are stapled while moving the staple driver 92 widthward. When moving the staple driver 92 in the width direction Wd to be placed at the desired stapling positions, the connecting member 96 formed in a substantially U-shape projects out of one of the side walls 92*a*. Accordingly, the stapler of this embodiment is applicable to a sheet handling device restricted by depth (length in the direction Fd). The widthward length of the connecting member 96 may be shortened by limiting the stapling area of the sheets as much as possible, because the sheets may partially admit into between the staple driver and the anvil.

Although the foregoing embodiments pertain to a vertical type stapler in that a staple is inserted downward from the upside or upward from the underside, the stapler of this invention may be used directing the staple driver in the horizontal direction so as to perform horizontal stapling.

In the foregoing embodiments, the support member (e.g. element 14*c* in FIG. 1 or element 84*c* in FIG. 12) is formed in a continuous strip like a rail on the bottom plate (22*c* in FIG. 1) or the upper plate (81*c* in FIG. 12) of the frame, this should not be understood as limitative. For example, as shown in FIG. 15, a plurality of support members 104*c* may be arranged discontinuously at the desired stapling positions of the lower surface of an upper plate 112*a* of a frame 112 so as to receive an impact caused when stapling.

Figure 15:
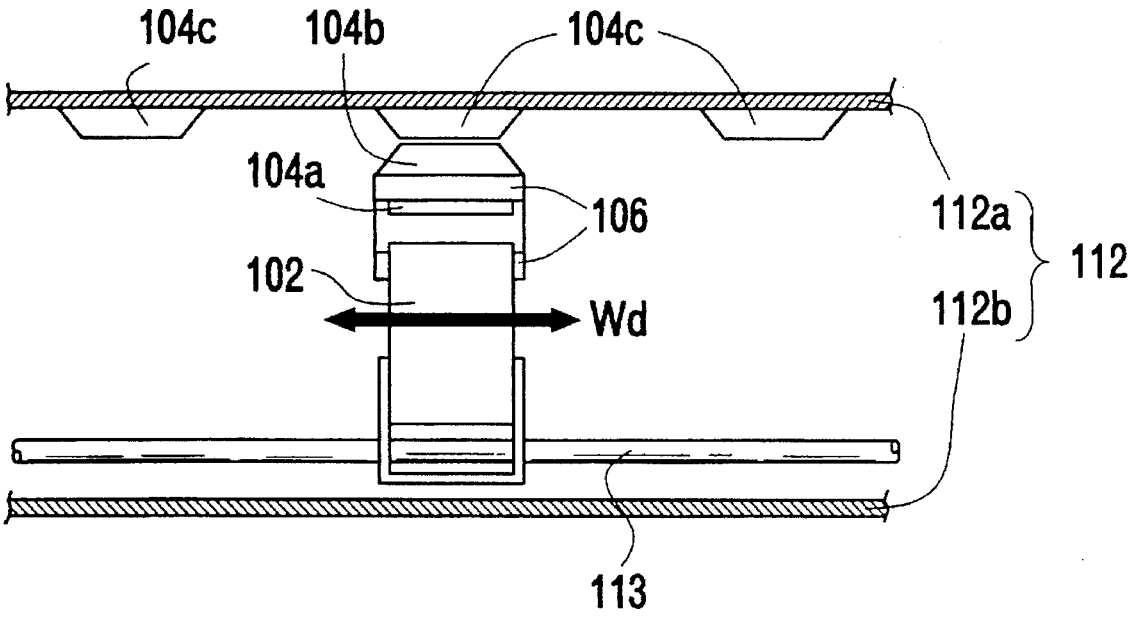
FIG. 15 is a schematic front view showing a ninth embodiment of the stapler of this invention.

In the embodiment of FIG. 15, an anvil 104*a* is attached onto the lower surface of a connecting member 106, and a slide member 104*b* is fixed on the upper surface of the connecting member. Although the slide member in the foregoing embodiment is formed of a roller (element 14*b* in FIG. 1), the slide member 104*b* in this embodiment is formed of a block piece having a trapezoidal section possessing inclined sides. As well, each support member 104*c* has side planes inclined in the directions opposite to the inclined sides of the slide member 104*b* so as to be prevented from being caught by the inclined sides of the slide member 104*b* when moving the staple driver 102 widthward along a guide rod or guide rods 113.

The illustrated embodiment in FIG. 15 has a function of inserting the staple upwardly from the underside. However, this stapler may be of course used in the inverted state so as to insert the staple downwardly from the upside like the stapler of FIG. 1. In this case, the support members may be arranged on the bottom plate 112*b* of the frame 112.

According to the embodiment of FIG. 15, the stapling positions can be visually recognized with ease by the support members 104*c* arranged on the upper plate 112*a* in the width direction Wd, and moreover, the stapler can be lightened to some extent because of the discontinuous support members compared with the rail-like continuous support member adopted in the foregoing embodiments.

As is apparent from the foregoing description, according to this invention, since one or more stapling portions of a sheaf of sheets can be arbitrarily bound with only one staple driving unit with efficiency, simplification in structure and compactness of the stapler can be accomplished. The stapler of the present invention capable of automatic sheet binding operation is convenient and applicable to all sorts of sheet handling devices such as a copying machine and printer and has an excellent function of rationally binding the sheets in a corner binding manner, one-side binding manner and doublespread binding manner without any restraint regardless of the width and length of the sheets to be bound.

Furthermore, the stapler of this invention can constitute a convenient sheet-binding system incorporated in the sheet handling device such as a copying machine and printer, which can automatically bind sheets discharged from the sheet handling device in a corner binding, one-side binding or doublespread binding manner.

As can be readily appreciated, it is possible to deviate from the above embodiments of the present invention and, as will be readily understood by those skilled in this art, the invention is capable of many modifications and improvements within the scope and spirit thereof. Accordingly, it will be understood that the invention is not to be limited by these specific embodiments, but only by the scope and spirit of the appended claims.

What is claimed is:

1. A stapler for binding sheets fed in a forwarding direction, comprising:

a staple driving unit including a staple driver for forcing a staple having pointed ends into said sheets, clinching means including an anvil for receiving and bending said pointed ends of said staple piercing through said sheets, into a non-returnable state, and a connecting member for connecting said staple driver with said clinching means; and moving means including one or more guide rods and a reversible motor, said moving means being connected to said staple driving unit through transmitting means to as to move said staple driving unit in the direction perpendicular to said forwarding direction, whereby said sheets are introduced into between said staple driver and said clinching means and bound with one or more staples at one or more prescribed stapling positions of the sheets.

2. A stapler according to claim 1, wherein said connecting member is formed in a substantially U-shape and extends in the forwarding direction so as to admit said sheets into between said staple driver and said clinching means.

3. A stapler according to claim 1, wherein said connecting member is formed in a substantially U-shape and extends in the direction perpendicular to said forwarding direction so as to partially admit said sheets into between said staple driver and said clinching means.

4. A stapler according to claim 1, wherein said staple driver is positioned above said clinching means so as to insert the staple downward.

5. A stapler according to claim 1, wherein said staple driver is positioned beneath said clinching means so as to insert the staple upward.

6. A stapler according to claim 1 further comprising a home position sensor for detecting said staple driving unit, said sensor being located out of an extent capable of admitting a sheet of a maximum size to be stapled.

7. A stapler for binding sheets fed in a forwarding direction, comprising:

a staple driving unit including a staple driver for forcing a staple having pointed ends into said sheets, clinching means including an anvil for receiving and bending said pointed ends of said staple piercing through said sheets, into a non-returnable state, and a connecting member for connecting said staple driver with said clinching means wherein said connecting member is formed in a substantially U-shape and extends in the forwarding direction so as to admit half said sheets into between said staple driver and said clinching means; and moving means including one or more guide rods, for moving said staple driving unit in the direction perpendicular to said forwarding direction, whereby said sheets are introduced into between said staple driver and said clinching means and bound with one or more staples at one or more prescribed stapling positions of the sheets.

8. A stapler for binding sheets fed in a forwarding direction, comprising:

a staple driving unit including a staple driver for forcing a staple having pointed ends into said sheets, clinching means including an anvil for receiving and bending said pointed ends of said staple piercing through said sheets, into a non-returnable state, and a connecting member for connecting said staple driver with said clinching means; and moving means including one or more guide rods, for moving said staple driving unit in the direction perpendicular to said forwarding direction, wherein said staple driver is movable rockingly relative to said connecting member and clinching means;

whereby said sheets are introduced into between said staple driver and said clinching means and bound with one or more staples at one or more prescribed stapling positions of the sheets.

9. A stapler for binding sheets fed in a forwarding direction with at least one staple having pointed ends, which comprises:

a staple driving unit including a staple driver for inserting the staple into said sheets, clinching means including an anvil for receiving and bending said pointed ends of said staple piercing through said sheets into a non-returnable state, one or more support members disposed opposite to at least one of said staple driver and said clinching means so as to come in contact with said staple driver or said clinching means when stapling, and a substantially U-shaped connecting member for connecting said staple driver with said clinching means, moving means including one or more guide rods, a reversible motor, and transmitting means interposed between said staple driver and said motor and adapted to move said staple driver in a direction perpendicular to said forwarding direction, and said staple driving unit being movable in the direction perpendicular to said forwarding direction along said guide rods, whereby said sheets are introduced into between said staple driver and said clinching means and bound with one or more staples at one or more prescribed stapling positions of the sheets.

10. A stapler according to claim 9, wherein said guide rod has a length defined by an effective width for admitting the sheets having a maximum width and a width of a home position to which said staple driving unit retreats.

11. A stapler according to claim 10, further comprising a home position sensor provided in said home position for detecting said staple driving unit.

12. A stapler according to claim 9, further comprising a slide member disposed between said support member and said staple driver or clinching means for assuring smooth movement of said staple driving unit.

13. A stapler according to claim 12, wherein said support member is formed of in a continuous rail-like strip.

14. A stapler according to claim 13, wherein said slide member is formed of a roller.

15. A stapler according to claim 12, wherein a plurality of said support members are discontinuously arranged at said stapling positions.

16. A stapler according to claim 15, wherein each of said support members is formed of a block piece having a trapezoidal section.

17. A stapler according to claim 9, wherein said connecting member is formed in a substantially U-shape and extends in the forwarding direction so as to admit said sheets into between said staple driver and said clinching means.

18. A stapler according to claim 9, wherein said connecting member is formed in a substantially U-shape and extends in the forwarding direction so as to admit half said sheets into between said staple driver and said clinching means.

19. A stapler according to claim 9, wherein said connecting member is formed in a substantially U-shape and extends in the direction perpendicular to said forwarding direction so as to partially admit said sheets into between said staple driver and said clinching means.

20. A sheet-binding system comprising:

(a) a stapler for binding sheets forwarded in a forwarding direction, which comprises:

a staple driving unit including a staple driver for forcing a staple having pointed ends into said sheets, clinching means including an anvil for receiving and bending said pointed ends of said staple piercing through said sheets into a non-returnable state, and a connecting member for connecting said staple driver with said clinching means; and moving means including one or more guide rods and a reversible motor, said moving means being connected to said staple driving unit through transmitting means so as to move said staple driving unit in the direction perpendicular to said forwarding direction, and (b) a collating unit comprising a stacker tray, a pair of side regulating plates movable for truing up said sheets fed onto said stacker tray, a stopper movable vertically so as to selectively bar said sheets being forwarded, and means for feeding said sheets into between said staple driver and said clinching means of said stapler.

21. A sheet-binding system according to claim 20, wherein said stopper of said collating unit is arranged between said side regulating plates and said clinching means of said stapler.

22. A sheet-binding system according to claim 21, further comprising a discharge tray arranged beyond said connecting member so as to discharge the sheets stapled by said stapler to said discharge tray, and a sheet sensor disposed on said discharge tray.

23. A sheet-binding system according to claim 21, further comprising said side regulating plates of said collating unit is carried on a carriage movable back and forth.

24. A sheet-binding system according to claim 20, wherein said stopper of said collating unit is arranged beyond said clinching means of said stapler.

25. A sheet-binding system according to claim 20, wherein said feeding means of said collating unit is driven forward to feed said sheets into between said staple driver and said clinching means in said forwarding direction, and reversed to discharge said sheets in the direction opposite to said forwarding direction.

26. A stapler for binding sheets fed in a forwarding direction, comprising:

a staple driving unit including a staple driver for forcing a staple having pointed ends into said sheets and clinching means including an anvil for receiving and bending said pointed ends of said staple piercing through said sheets, into a non-returnable state; and moving means including one or more guide rods and a reversible motor, said moving means being connected to said staple driving unit and said clinching means through transmitting means so as to move said staple driving unit along with said clinching means in the direction perpendicular to said forwarding direction, whereby said sheets are introduced into between said staple driver and said clinching means and bound with one or more staples at one or more prescribed stapling positions of the sheets.

* * * * *